United States Patent [19]

Dreyer et al.

[11] Patent Number: 4,801,101

[45] Date of Patent: Jan. 31, 1989

[54] WALLBOARD CUTTER

[75] Inventors: Fredrick B. Dreyer, St. Louis, Mo.; Daniel T. Maloney, Cahokia, Ill.

[73] Assignee: Gruendler Crusher and Pulverizer, Co., St. Louis, Mo.

[21] Appl. No.: 83,268

[22] Filed: Aug. 5, 1987

[51] Int. Cl.[4] ..... B02C 18/16

[52] U.S. Cl. ..... 241/240; 241/243; 241/294

[58] Field of Search ..... 241/242, 241, 243, 230, 241/293, 231, 294, 239, 240, 232, 233, 190

[56] References Cited

U.S. PATENT DOCUMENTS

| | | | |
|---|---|---|---|
| 1,402,199 | 1/1922 | Williams . | |
| 1,676,048 | 7/1928 | Philbrick . | |
| 2,584,262 | 2/1952 | De Lamater . | |
| 2,655,213 | 10/1953 | Anderson . | |
| 2,669,271 | 2/1954 | Treckmann . | |
| 2,830,772 | 4/1958 | Martin | 241/186 |
| 2,869,793 | 1/1959 | Montgomery | 241/50 |
| 2,958,474 | 11/1960 | Meyer | 241/192 |
| 2,986,347 | 5/1961 | Stevenson | 241/191 |
| 3,001,728 | 9/1961 | Kircher | 241/73 |
| 3,170,642 | 2/1965 | Haidler | 241/186 |
| 3,462,087 | 8/1969 | Butler et al. | 241/186 |
| 3,762,256 | 10/1973 | Frantz | 241/243 X |
| 3,847,362 | 11/1974 | Lowe et al. | 241/191 |
| 4,015,782 | 4/1977 | Granite | 241/62 |
| 4,059,236 | 11/1977 | Brewer | 241/243 |

FOREIGN PATENT DOCUMENTS

| | | | |
|---|---|---|---|
| 1342354 | 1/1974 | United Kingdom | 241/243 |

*Primary Examiner*—Mark Rosenbaum
*Attorney, Agent, or Firm*—Grace J. Fishel

[57] ABSTRACT

A shredder having a stationary comb cutter and primary and secondary cutters on the rotor providing "punch and die" shearing action suitable for shredding wallboard or the like. Means for metering the incoming feed through a pair of nip rollers, the upper set of which is spaced inboard such that they do not press on the side edges of the wallboard as it passes through the nip.

10 Claims, 3 Drawing Sheets

FIG. 3
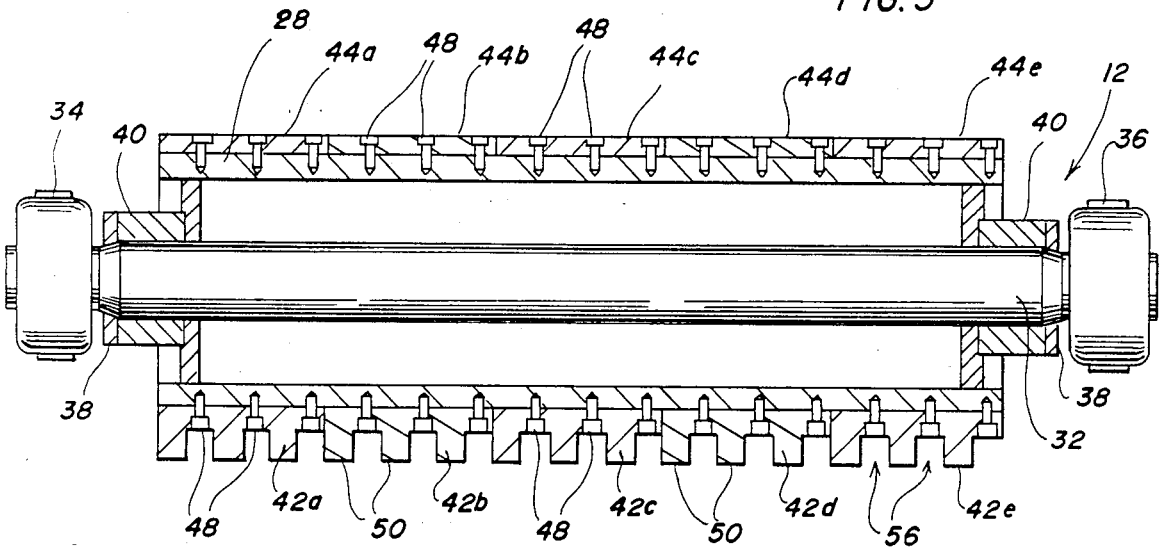
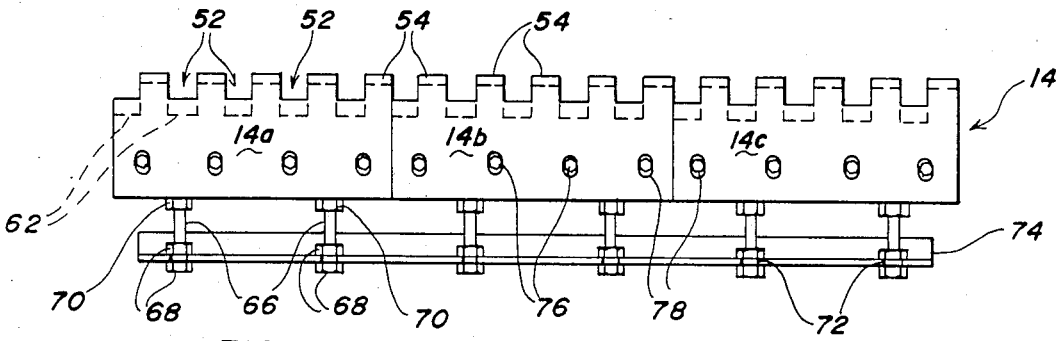
FIG. 4
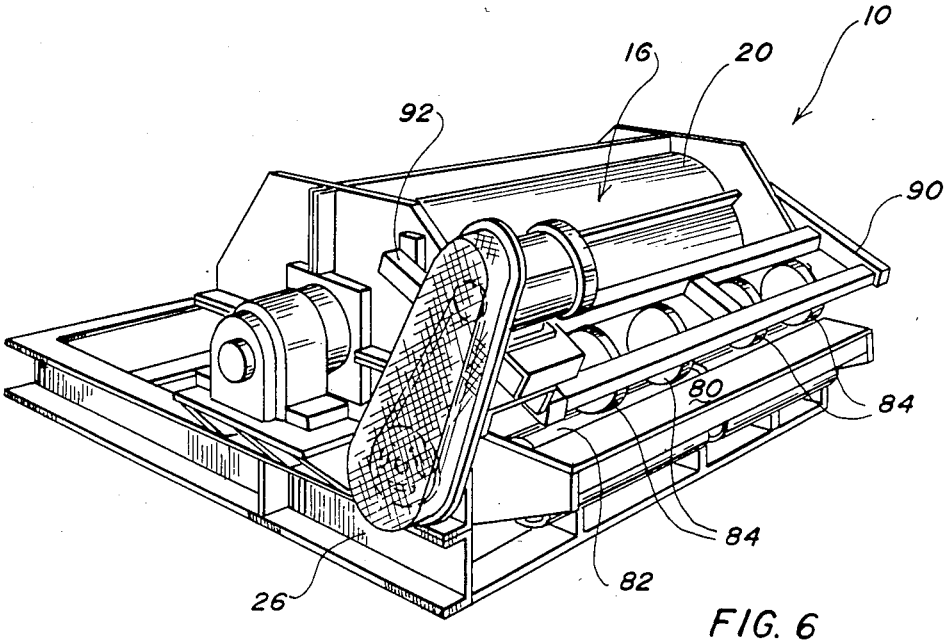
FIG. 6

WALLBOARD CUTTER

BACKGROUND OF THE INVENTION

1. Field of the Invention

The present invention relates to a shredder for cutting rejected wallboard into particles of selected size and shape compacted for disposal or suitable for recycling into wallboard.

Wallboard usually consists of a core of gypsum sandwiched between two layers of paper. It conventionally measures ½01" thick, 48" wide and 8 to 20 feet in length. In manufacture, a plaster slurry containing a catalyst is mixed and discharged on a moving web of paper. The edges of the bottom paper are scored and folded so that the slurry is completely contained between that sheet and the top paper, which is laid on the slurry. The paper surfaces provide strength and paintability to the finished board and form a continuous mold within which the gypsum is cast. Within about five minutes after forming, the gypsum is sufficiently hard to be cut, after which the sheets are dried further before storage and shipment.

A wallboard machine operates continuously and most rejects occur at start-up and during splicing of the paper. During start-up, the upper and lower papers are typically folded into a nose cone and the paper started through the machine. At this time, water containing varying amounts of gypsum and catalyst is directed onto the first 50 to 60 feet of paper passing through the machine before the mix is correct. The rejected material during this interval consists of dry paper, wet paper and paper containing cured and uncured slurry of variable composition. When the paper is spliced and during normal runs, the rejected material primarily consists of torn wallboard or wallboard which is imperfectly wrapped or sized.

Rejected wallboard can be either recycled or dumped. When it is dumped, the boards are typically dropped into a trash gondola but their size and shape do not allow for close packing, resulting in the gondola filling up long before its weight capacity is reached. If the wallboard could be shredded into regularly sized, relatively small particles, this would increase the density of the material dumped into the gondola and fewer containers would be needed, resulting in significant savings in hauling costs. Some wallboard plants can recycle rejected wallboard if it is cut to a correct size. For example, when the gypsum rock is pulverized in a roller mill, shredded wallboard can be added with the rock as long as the particles are no bigger than about 2×2". It is very difficult, however, to control particle size of the wallboard in a conventional shredder using a grate or screen since the combination of uncured gypsum mix and paper produces a sticky mass which tends to block the discharge holes. If the grate or screen is removed, on the other hand, there is no control on the size of the product, especially the paper, and it then tends to gum up the roller mill or, if the material is being dumped, adversely effects density, increasing disposal costs.

2. Brief Description of the Prior Art

Shredders having a scissoring action making use of intermeshing comb cutters on the rotor and stationary cutter have been used in the past. These mills, however, do not provide a "punch and die" action in the sense that the material is not cleanly sheared because it is impracticable to machine the comb cutters to mesh in such close tolerance that the material undergoing reduction is both (1) supported by the projecting teeth of the stationary comb at the cut made by the rear of the cutter pockets in the opposing comb and (2) supported by the stationary comb adjacent the rear of the cutter pockets in said comb at the cut made by the projecting teeth in the opposing comb. Usually, some gap is provided between the rear of the cutter pockets and the corresponding projecting teeth of each set of opposing combs. While this arrangement is all right for friable materials, it is not well suited for nonfriable materials such as wallboard which requires far more shearing force.

In view of the above, it is an object of the present invention to provide a shredder with an improved comb cutter providing "punch and die" shearing action suitable for shredding wallboard into particles of selected size and shape. It is a further object to provide means for metering the incoming feed into the shredder. Other objects and features of the invention will be in part apparent and in part pointed out hereinafter, the scope of the invention being indicated by the subjoined claims.

SUMMARY OF THE INVENTION

The invention accordingly comprises a shredder having an improved comb cutter providing "punch and die" shearing action suitable for shredding wallboard or the like. Means for metering the incoming feed into the shredder are also described.

BRIEF DESCRIPTION OF THE DRAWINGS

In the accompanying drawings, in which several of various possible embodiments of the invention are illustrated, corresponding reference numerals refer to corresponding parts, and in which:

FIG. 3 is a rotated sectional view showing primary and secondary cutters taken along line 3—3 in FIG. 2;

FIG. 4 is a plan view of a stationary cutter;

FIG. 6 is a perspective view of a wallboard cutter as shown in FIG. 1 including a pair of nip rollers for metering wallboard into the shredder;

DETAILED DESCRIPTION OF THE INVENTION

Figure 1:
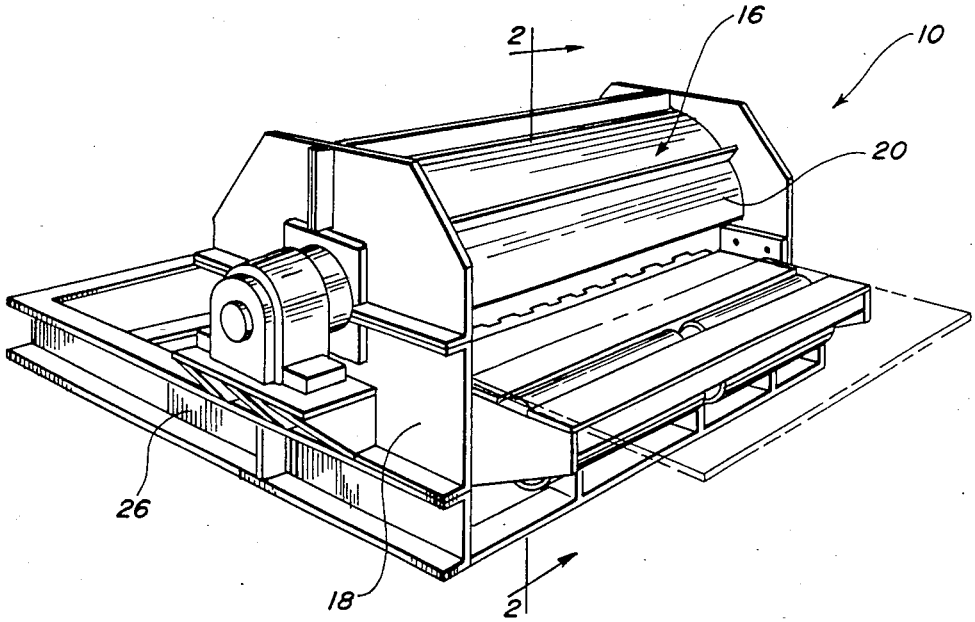
FIG. 1 is a perspective view of a wallboard cutter in accordance with the present invention.

Referring to the drawings more particularly by reference character, reference numeral 10 refers to a wallboard cutter in accordance with the present invention. Cutter 10 includes a rotor 12 and a stationary cutter or anvil 14 as more particularly described hereinafter enclosed within a housing 16, shown divided into a lower section 18 and upper front and rear sections 20 and 21. Rear section 21 is hinged at 22 such that the top quarter of the mill can be opened for easy access to the rotor. Discharge opening 24 is unimpeded and housing 16 is shown seated upon a short pedestal or base 26. Heavy duty support legs (not shown) can be mounted beneath the base, if desired, to accommodate a conveyor for removal of cut material which is gravity discharged from the mill.

Figure 2:
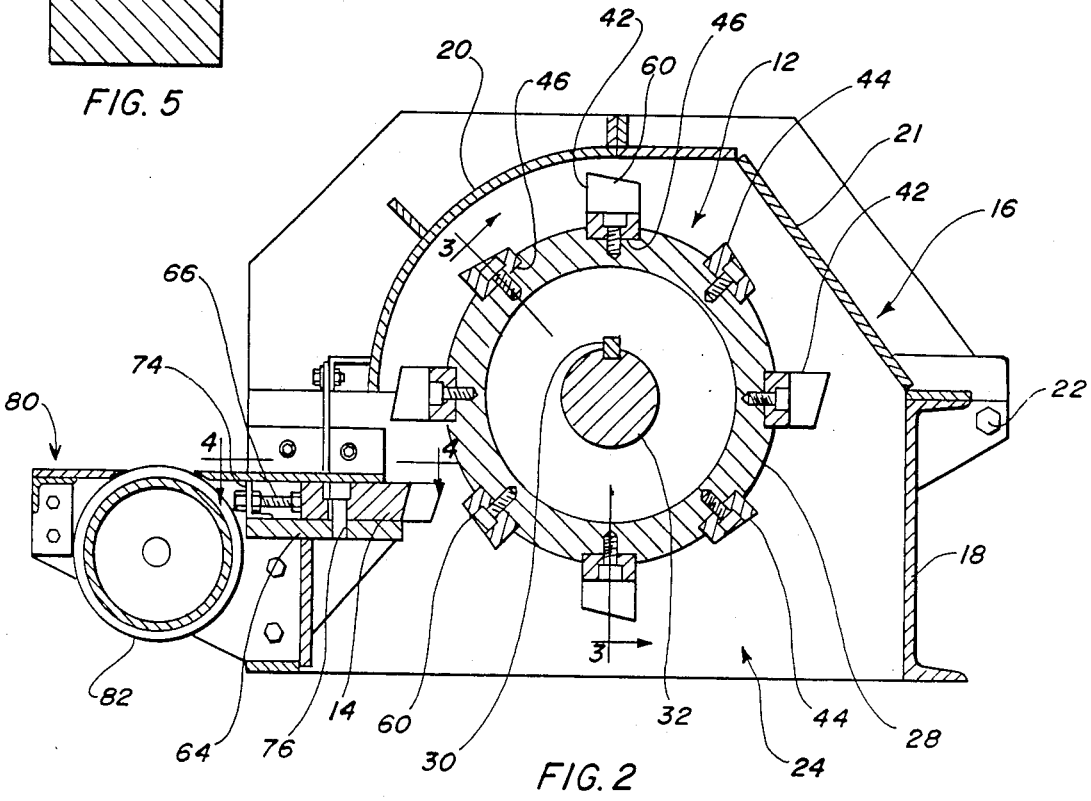
FIG. 2 is a sectional view taken along line 2—2 in FIG. 1.

As best seen in FIG. 3 taken in combination with FIG. 2, rotor 12 is disposed within housing 16 and comprises a drum 28 with means mounting the drum, shown as key 30, to a transversely extending shaft 32 rotatably mounted on the housing. One end of shaft 32 is journaled in a bearing 34 fixed with respect to housing 16 and the other end of which is journaled into a floating bearing 36 to allow for thermal expansion. Means are provided such that drum 28 is laterally adjustable on shaft 32, said means illustrated by locknuts 38 holding drum 28 in selected position between spacers 40. Drum 28 is preferably hollow to lighten construction and can be replaced with other drums to accommodate different numbers of cutters.

Rotor 12 is provisioned with a set of primary and secondary cutters 42 and 44, respectively, shown divided into a plurality of sections, 42*a*, 42*b* and so forth, and symmetrically mounted in alternating rows about the periphery of drum 28. As best seen in FIG. 2, a groove 46 parallel the longitudinal axis of drum 28 serves as a seat for cutters 42 and 44 reducing the shear on bolts 48 which function primarily to hold the cutters on radially. For reasons which will become apparent, cutters 42 and 44 are counterbored for receipt of the heads of bolts 48.

Each primary cutter 42 comprises a comb with squared off projections or teeth 50 which are distributed and dimensioned to pass in close tolerance through a correspondingly squared off recessed area or pocket 52 in stationary cutter 14 comprising a comb with complementary teeth 54. Teeth 50 and 54 are preferably regularly spaced with their front edges substantially parallel to the axis of rotation of rotor 12 and with their side edges generally perpendicular thereto so that cut pieces will be severed into uniform rectangular or square particles. Teeth 50 are longer in length than pockets 52 are deep such that the rear of cutter pockets 56 between said teeth 50 does not make a cut with teeth 54 on stationary cutter 14. Each secondary cutter 44, on the other hand, comprises a squared off shear bar dimensioned to pass in close tolerance to the front edges of squared off teeth 54 thus completing a "punch and die" cut about all four edges of each piece. By close tolerance is meant, for example, only a few thousandths of an inch. Stationary cutter or anvil 14 is sectioned like primary and secondary cutters 42 and 44 preferably in such manner that the break line between adjacent units is at the side edge of a tooth on the opposing cutting unit for the purpose of giving a clean cut. To this end as illustrated in FIG. 4, stationary cutter 14 is made up of three sections whereas as illustrated in FIG. 3 primary and secondary cutters 42 and 44 have five. Other configurations are of course possible, including forming stationary cutter 14 and primary and secondary cutters 42 and 44 as single pieces although sections are preferred for ease of fabrication, installation and replacement.

Figure 5:
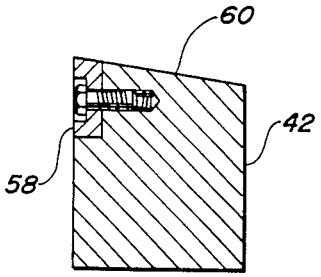
FIG. 5 is an enlarged sectional view of one of the primary cutters shown in FIG. 2.

The cutting surfaces of stationary cutter 14 and primary and secondary cutters 42 and 44 are provided with a heat hardened, wear resistant surface. An optional insert 58, as shown in FIG. 5, can be provided on the point of each cutting element to facilitate repair of the cutting surfaces which is less costly than replacing an entire section. As shown in FIGS. 2 and 5, a relief 60 is provided beyond the cutting point of primary and secondary cutters 42 and 44 to allow the board to advance into the mill between hits and prevent kickback of the board in the infeed direction, as well as to provide a sharpened cutting edge. A corresponding relief 62, shown in dotted lines in FIG. 4, is also provided beyond the cutting point of stationary cutter 14 to provide a sharpened edge. The greater the rake of reliefs 60 and 62, the sharper the cutting action but the cutting tips are correspondingly weakened.

Since primary and secondary cutters 42 and 44 make individual cuts on the material as it is fed into the mill as above described, the number of rows of primary and secondary cutters effect the number of full coverage hits per revolution of the rotor. For example, when there are eight cutters, four primary cutters 42 and four secondary cutters 44, there are four full coverage hits per revolution. It will be readily understood that for a given number of cutters and at a given line speed for the incoming material, the speed of the rotor effects the particle size. Of course particle size could be selected the other way around but as a practical matter the line speed that the wallboard is fed into the cutter is fixed by the line speed of the customer's wallboard machine.

Theoretically, the circumferential distance between adjacent rows of primary and secondary cutters 42 and 44 may be slightly greater than the thickness of the wallboard being shredded, but for practical design, it is preferred that the distance be considerably greater. Since it is important that rotor 12 be brought up to operating speed quickly as the machine is designed for intermittent use, there is a practical balance between number of cutters and acceptable motor size since the less inertia on the drum, the less force it takes to start it moving and the quicker it can be brought up to operating speed. On the other hand, the circumferential distance between adjacent rows of primary and secondary cutters 42 and 44 cannot be too great otherwise there is insufficient momentum behind the cutters and the rotor must be driven excessively fast to keep up with the board being fed into the shredder. By way of example, it has been found that a rotor having a diameter between about 24 and 30" and driven at a speed between about 600 and 2400 RPM can have between about 4 and 12 cutters and operate within the above mentioned parameters for cutting wallboard.

As shown in FIG. 2, stationary cutter 14 is supported by a support block 64 forming an integral portion of lower section 18 of housing 16 at such elevation that the stationary cutter is in a plane passing below the centerline of shaft 32. Separate means are provided in association with each section for adjusting the section toward and away from rotor 12 for setting tolerances between the primary and secondary cutters and the stationary cutter and to compensate for wear. As shown in FIGS. 2 and 4, such means takes the form of bolt paris 66, the free end of which is held between nuts 68 which are fixed on bolts 66 in slots 72 formed in a vertical leg of a piece of angle iron 74 secured by its horizontal leg to block 64. The opposite end of blots 66 is threaded into a section of stationary cutter 14 on a side opposite teeth 54. It will be understood that each section of stationary cutter can be moved on support block 64 toward and away from the drum by screwing bolts 66 in or out of said section, however movement is limited by bolt 76 within the confines of counterbored slots 78. Locking nut 70, on the other hand, provides a means to prevent turning of bolt 66 once correct adjustment of anvil 14 is achieved. When the stationary cutter sections have been satisfactorily positioned, they are secured against further movement by tightening down bolts 76 which are threaded into support block 64.

Table 80 forms an extension of lower housing 18 at the feed opening, the lower surface of which as shown in FIG. 2 is at the same elevation as the upper surface of stationary cutter 14. Wallboard cutter 10 is preferably positioned with table 80 adjacent the discharge end of a conveyor down which is passed rejected material to be fed into the mill. Table 80 may include means for rotatably mounting a roller, or a pair of rollers, 82 having upper surfaces as shown in FIGS. 2 and 6 protruding through an opening in the table so that the periphery of the roller is slightly above the upper surface of the table. In this form, roller 82 may be used to feed material into the mill, in which case its speed of rotation is preferably matched with the line speed of the conveyor.

Figure 7:
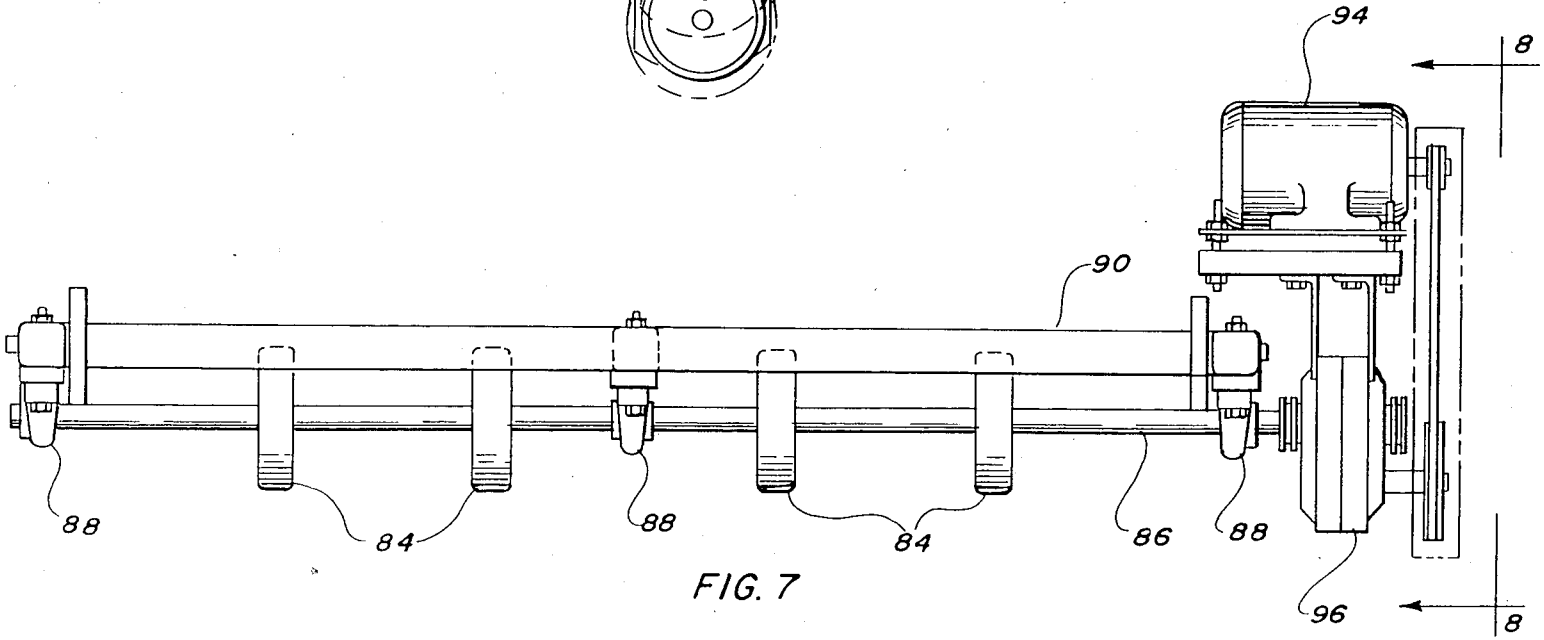
FIG. 7 is a front elevational view of the upper set of rollers as shown in FIG. 6; and, FIG. 8 is a side elevational view of the rollers shown in FIG. 7 taken in the direction of line 8—8.
Figure 8:
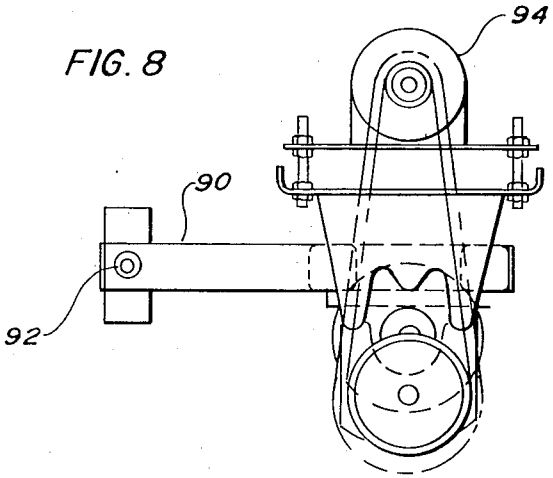

In other instances, as shown in FIG. 6, it may be advantageous to provide a second roller for use in cooperation with the first for pressing and holding the material being fed into the mill, as well as positively driving the material into the rotor at a uniform rate of speed. As best seen in FIGS. 7 and 8, this second roller is preferably made up of a plurality of relatively narrow rollers or pneumatic tires 84 rotatably mounted on a shaft 86 which is journaled at its opposite ends and midpoint in bearings 88. Bearings 88 are carried by a generally U-shaped frame 90, the free ends of which are pivotally mounted at 92 to upper front section 20 of housing 16. Also carried on frame 90 is a motor 94 driving rollers 84, preferably at the same speed as roller 82, through the intermediary of gear reducer 96. Frame 90 with its associated rollers is gravity held against roller 82. The first roller at each end of shaft 86 is spaced inboard such that rollers 84 do not press on the side edges of the wallboard as it is passed through the nip between said rollers. In the embodiment shown in FIG. 6, upper roller 84 exerts a downward pressure on the wallboard, but not enough to squeeze uncured gypsum out the side edges, and the rotation of rollers 82 and 84 aids in starting the wallboard into the shredder. Once the sheet has started through the mill, rollers 82 and 84 serve as a holdback since the rotation of the primary and secondary cutters tends to draw the wallboard into the mill at a faster rate than the line speed of the reject conveyor. This is not desirable since an increase in the feed rate changes the particle size.

A characteristic of the prior art cutters is that they are fed continuously. For use in shredding wallboard, however the wallboard cutter of the present invention is designed to be brought up to operating speed quickly and operated intermittently because during a normal wallboard run, there are typically no more than 2–4 rejected boards per hour. In use, a sheet of rejected wallboard is directed onto a reject conveyor, the discharge end of which mates with table 80 of wallboard shredder 10. As the rejected wallboard moves down the conveyor, a switch is triggered and rotor 12 and rollers 82 and 84, if present, are quickly brought up to operating speed. Preferably start-up time is within seconds, as this time dictates the length of the reject conveyor as it must delay feeding the board into the machine until it reaches operating speed.

As the wallboard crosses stationary cutter 14, it is first impacted by teeth 50 which make a cut in pocket 52. Shortly thereafter as the wallboard passes over the leading edge of teeth 54, secondary cutter 44 is brought into play. It can be readily seen that by staggering the cuts between primary and secondary cutters 42 and 44 that adjacent cuts are not made simultaneously and such stepwise cutting eliminates the possibility of two or more particles being incompletely severed.

While the operation of the subject shredder has been described with respect to wallboard, it will be understood that the mill can be used advantageously to shred any other material which comes in flat sheets, is typically moved by conveyor and is not friable. In view of the above, as various changes could be made in the above constructions without departing from the scope of the invention, it therefore is intended that all matter contained in the above description or shown in the accompanying drawings shall be interpreted as illustrative and not in a limiting sense.

What is claimed:

1. A shredder comprising a housing with a feed opening, a rotor disposed within the housing, a transversely extending shaft rotatably mounted on the housing, a drum with means mounting the drum on the shaft for rotation therewith, said drum having primary and secondary cutters mounted in rows about the periphery thereof longitudinal to the shaft and a stationary cutter mounted on a support block fixed to the housing at an elevation such that the stationary cutter is in a plane passing below the centerline of the shaft, said primary and stationary cutters comprising opposing combs, each of which has squared off projections which are distributed and dimensioned to pass in close tolerance through a correspondingly squared off recess between the squared projections of the opposite comb, the projections of the primary cutter being longer than the recessed area between the squared off projections of the stationary cutter is deep such that the rear edge of the recessed area between said projections of the primary cutter does not form a cutting surface with the projections of the stationary cutter, said secondary cutter comprising a squared off bar dimensioned to pass in close tolerance to the squared off projections on the stationary cutter whereby said primary and secondary cutters make individual "punch and die" cuts.

2. The shredder of claim 1 having means for laterally adjusting the drum on the shaft to bring the primary cutter into mesh with the stationary cutter.

3. The shredder of claim 1 having means for moving the stationary cutter on the block towards and away from the rotor for setting the tolerance between the cutting surfaces of the primary and secondary cutters and the stationary cutter.

4. The shredder of claim 3 wherein the primary and secondary cutters are sloped away from the point of contact with the stationary cutter in a direction opposite the direction in which said cutters are rotated to allow the material being fed into the mill to advance into the mill between hits and to prevent kickback thereof.

5. The shredder of claim 4 wherein the primary, secondary and stationary cutters are sectioned.

6. The shredder of claim 5 wherein the breakline between adjacent stationary cutter sections is at the side edge of the opposing primary and secondary cutter sections.

7. A shredder for shredding wallboard comprising a housing with a feed opening, a rotor disposed within the housing and positioned above an open discharge opening, a transversely extending shaft rotatably mounted on the housing, a drum with means mounting the drum on the shaft for rotation therewith, said drum having primary and secondary cutters mounted in rows about the periphery thereof longitudinal to the shaft and a stationary cutter mounted on a support block fixed to the housing at an elevation such that the stationary cutter is in a plane passing below the centerline of the shaft, said primary and stationary cutters comprising opposing combs, each of which has squared off projections which are distributed and dimensioned to pass in close tolerance through a correspondingly squared off recess between the squared off projections of the opposing comb, the projections of the primary cutter being longer than the recessed area between the squared off projections of the stationary cutter is deep such that the rear edge of the recessed area between said projections does not form a cutting surface with the projections of the stationary cutter, said secondary cutter comprising a squared off bar dimensioned to pass in close tolerance to the squared off projections on the stationary cutter, means for moving the stationary cutter on the block towards and away from the rotor for setting the tolerance between the cutting surfaces of the primary and secondary cutter and the stationary cutter and an upper and lower opposing roller for metering the wallboard into the feed opening.

8. The shredder of claim 7 wherein the upper roller comprises a plurality of spaced apart rollers beginning inboard of the outboard edge of the wallboard fed between said upper and lower rollers.

9. The shredder of claim 8 wherein the upper roller is mounted on a frame pivoted to the housing and wherein the lower roller is mounted in a table forming an extension of the housing at the feed opening of the shredder, said upper roller gravity held against the lower roller and means for rotating the upper and lower rollers and matching said speed with the speed that the wallboard is fed into the shredder.

10. The shredder of claim 8 wherein the upper set of rollers comprises pneumatic tires.

* * * * *